United States Patent [19]

Wüthrich et al.

[11] 4,375,023

[45] Feb. 22, 1983

[54] GAS-BLAST SWITCH

[75] Inventors: Hans-Rudolf Wüthrich; Hubert Speigel, both of Oberentfelden; Hermann Lehner, Gränichen; Peter Krebs, Hirschthal, all of Switzerland

[73] Assignee: Sprecher & Schuh AG, Aarau, Switzerland

[21] Appl. No.: 138,116

[22] Filed: Apr. 7, 1980

[30] Foreign Application Priority Data

Jul. 10, 1979 [CH] Switzerland ..... 6416/79

[51] Int. Cl.[3] ..... H01H 33/70; H01H 33/12

[52] U.S. Cl. ..... 200/148 R; 200/146 R; 200/148 A

[58] Field of Search ..... 200/146 R, 148 R, 148 A

[56] References Cited

U.S. PATENT DOCUMENTS 4,296,289 10/1981 Wuthrich et al. ..... 200/146 R

*Primary Examiner*—Robert S. Macon

*Attorney, Agent, or Firm*—Werner W. Kleeman

[57] ABSTRACT

A movable, tubular-shaped contact element is displaceably guided in a partition wall subdividing the internal space of the gas-blast switch housing into an extinguishing chamber and an expansion chamber. During the cut-off stroke a current connection prevails by means of this contact element between both of the chambers or compartments. The contact element coacts with a stationary or fixed contact set having a rim of rated current contacts which, in the cut-on position, engage about the contact element. Further, there is provided a burn-off ring which is electrically connected with the contact element and has an electrically insulated, suspended intermediate electrode which, in the cut-on position, engages into the contact element or piece. The latter, during the cut-off stroke, initially comes out of engagement with the rated current contacts and first thereafter comes out of engagement with the intermediate electrode. In order to ensure that the part of the switching arc which burns between the burn-off ring and the intermediate electrode remains at this location and that its other part, even in the presence of low currents, is sufficiently blown, the burn-off ring is arranged within the rim of rated current contacts and is rearwardly inset with respect to the contact surfaces thereof, and furthermore, a pump device is coupled with the movable contact element. This pump device, during the cut-off stroke, conveys extinguishing gas out of the region of the extinguishing chamber which is remote from the separation path to the separation path.

7 Claims, 1 Drawing Figure

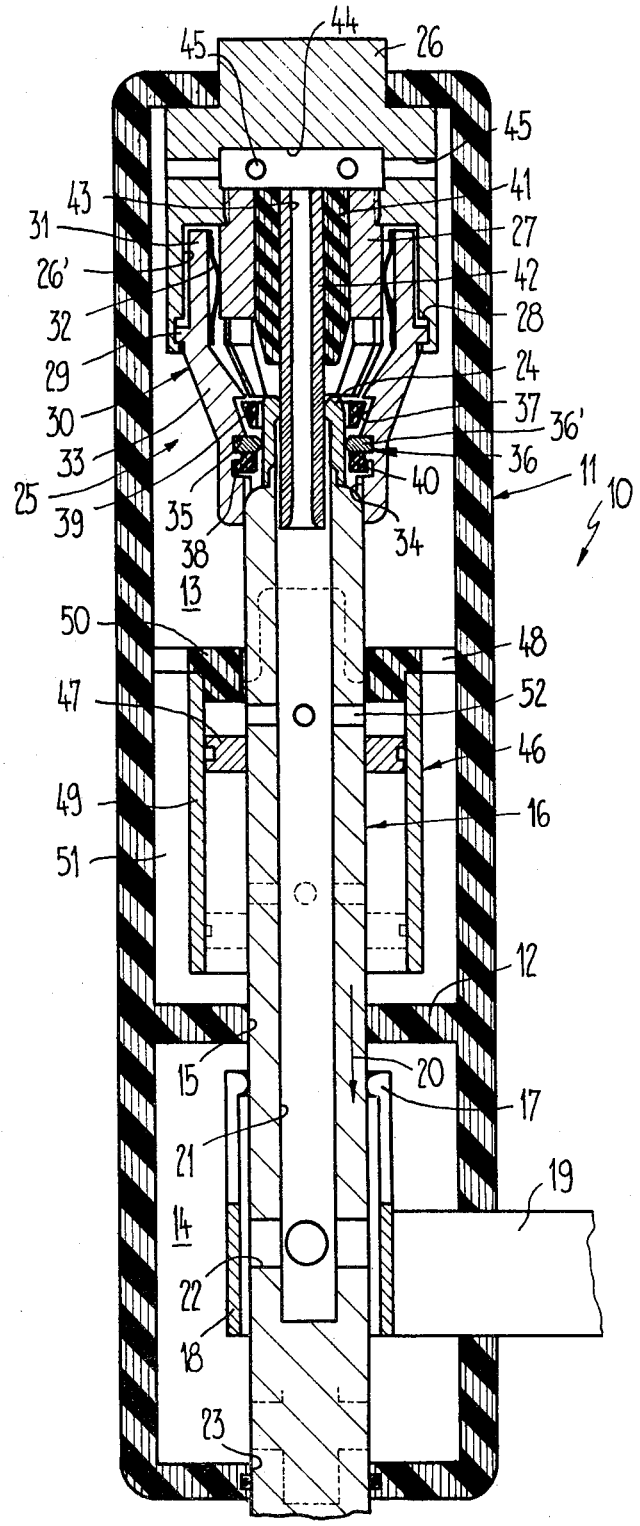
44
45
26
45
43
41
31
27
26'
42
32
28
29
24
30
37
36'
33
36
25
40
11
10
39
35
34
38
13
50
48
47
52
46
49
16
51
12
15
20
17
21
19
14
22
18
23

GAS-BLAST SWITCH

BACKGROUND OF THE INVENTION

The present invention relates to a new and improved construction of a gas-blast switch.

Generally speaking, the gas-blast switch of the present development is of the type containing a movable, substantially tubular-shaped and displaceable contact element or piece which is guided by a partition or separation wall which subdivides the internal space or compartment of the switch housing into an extinguishing chamber and an expansion chamber. By means of the contact element, during the course of a cut-off stroke, there can be established a current connection between both of these chambers. There is also provided a stationary contact set arranged in the extinguishing chamber or compartment and coacting with the movable contact element. The contact set, in turn, contains a rim of rated current contacts which, in the cut-on position, engages about the movable contact element. Further, there is provided a burn-off ring which is electrically connected with the rated current contacts and an intermediate electrode which is electrically insulated from the rated current contacts. The intermediate electrode in the cut-on position sealingly engages into the movable contact element, and such during the course of the cut-off stroke initially comes out of engagement with the rated current contacts and only afterwards comes out of engagement with the intermediate electrode, so that initially an arc is drawn between the burn-off ring and the intermediate electrode.

Such type of gas-blast switches are typically, although not exclusively, used for intermediate voltages in a range of 1–36 kV.

With heretofore known switches of this type there does not exist any adequate assurance that the arc which is drawn between the burn-off ring and the intermediate electrode will not commutate back from the burn-off ring to the rated current contacts, as soon as the movable contact element has departed from the intermediate electrode, and thus, has released the flow connection from the extinguishing chamber or compartment to the expansion chamber or compartment.

Additionally, the heretofore known gas-blast switches likewise afford little assurance, in particular during the cut-off of comparatively low currents, that there will be a rapid extinguishing of the switching arc, since the pressure build-up produced by the switching arc in this case is too low in order to ensure for an uninterrupted outflow of the heated gas through the movable contact element, and thus, to equally ensure for the blowing of the switching arc by inflowing extinguishing gas.

SUMMARY OF THE INVENTION

Therefore, with the foregoing in mind it is a primary object of the present invention to provide a new and improved construction of gas-blast switch which is not afflicted with the aforementioned drawbacks and limitations of the prior art constructions.

Another and more specific object of the present invention aims at providing a new and improved construction of a gas-blast switch of the previously mentioned type wherein the aforementioned impermissible operations are extensively eliminated.

Now in order to implement these and still further objects of the invention, which will become more readily apparent as the description proceeds, the proposed construction of gas-blast switch of the present development is manifested by the features that the burn-off ring is arranged within the rim of rated current contacts and is rearwardly inset with respect to its contact surfaces coacting with the movable contact element. Further, a pump device is operatively coupled with the movable contact element, which pump device during the cut-off stroke conveys an extinguishing gas out of the region of the extinguishing chamber removed or remote from the separation path to the region of the separation path.

BRIEF DESCRIPTION OF THE DRAWING

The invention will be better understood and objects other than those set forth above will become apparent when consideration is given to the following detailed description thereof. Such description makes reference to the annexed drawing wherein the single FIGURE shows in schematic axial sectional view, not to scale, a gas-blast switch constructed according to the invention, and in this sectional view there have been omitted as a matter of convenience in illustration all elements of the gas-blast switch which are unimportant for understanding the underlying principles and concepts of the present development in order to simplify the showing and to enhance clarity of illustration.

DETAILED DESCRIPTION OF THE PREFERRED EMBODIMENTS

Describing now the drawing, the exemplary illustrated embodiment of gas-blast switch 10 shown therein will be seen to comprise a housing 11 formed of any suitable electrically insulating material, the internal space or compartment of which is subdivided by an intermediate or partition wall 12 into an extinguishing chamber 13 and an expansion chamber 14. Formed in the intermediate wall 12 is a bore 15 in which there is displaceably guided an essentially tubular-shaped, movable contact element or piece 16. Within the expansion chamber 14, the outer diameter or surface of the movable contact element 16 always is in engagement with a set of resilient slide contacts 17, supported by a holder ring 18. The holder ring 18, in turn, is attached to a connection line or conductor 19 which extends radially out of the housing 11. The not particularly illustrated lower end of the movable contact element 16 which extends out of the housing 11 through a sealed through passage or opening 23, is operatively coupled with a standard drive as is known in this technology, by means of which the contact element, here shown in the cut-on position, can be shifted in the direction of the arrow 20 to assume the cut-off position shown schematically in broken lines. The movable contact element 16 possesses an axial blindhole bore 21, from the lower end of which there emanate radial passages 22 which open into the expansion chamber 14.

The upper end of the contact element 16 is formed by a likewise substantially tubular-shaped burn-off tip 24, for instance formed of a copper-tungsten (Cu-W)-alloy, the inner surface or diameter of which is in alignment with the blindhole bore 21, whereas its outer diameter is smaller than that of the remaining region of the contact element 16.

The movable contact element 16 and together therewith the burn-off tip 24 coact with a set 25 of fixed contact elements. This fixed contact element set 25 is supported at a metallic holder block or element 26 simultaneously serving as a housing closure and as a closure flange and at a holder tube 27 threadably connected with the holder block 26, as shown. The holder block or element 26 which is essentially of pot-shaped configuration and structured such that it is open towards the bottom, possesses at the region of its edge an inwardly open groove 28. Cams 29 or equivalent structure engage in this groove 28, the cams 29 being formed at the outside of contact fingers 30 or the like constructed as a double-arm lever. The arm 31 of the contact finger 30 which merges with the upper side of each cam 29 is exposed to the action of a leaf or blade spring 32 or equivalent structure which is supported at the outside of the holder tube 27. The leaf spring 32 strives to force the arm 31 outwardly. The arm 33 of each contact finger 30, which merges with the underside of each cam 29, carries at the region of its end, at its inner surface, a contact surface 34, which, in the illustrated cut-on position, bears under the action of the leaf or blade spring 32 snugly against the outer periphery of the movable contact element 16.

Rearwardly inset or offset with respect to the contact surface 34 is a notch or groove 35 provided at the inner surface of each of the arms 33. Inserted into the notches 35 of the contact fingers 30, arranged in a rim or crown configuration with intermediate spaces, is a respective burn-off element or piece 36'. These burn-off elements or pieces 36' therefore form a burn-off ring 36, the inner diameter of which corresponds approximately to the outer diameter of the burn-off tip 24 or is slightly greater than such outer diameter. To both sides of the notches 35 there is formed at the inner surface of each of the arms 33 a respective further, inwardly open notch 37 and 38, in which there is inserted a respective ring-shaped insert 39 and 40 formed of a material which gives off a gas under the influence of the arc, for instance formed of polytetrafluoroethylene which is leaned or cut with a suitable filler. The inner diameter of the inserts 39 and 40 is somewhat larger than that of the burn-off ring 36.

Attached within the holder tube 27 is an insulating or insulator sleeve 41 within which there is mounted a substantially tubular-shaped intermediate electrode 42, preferably formed of a non-metallic electrically conducting material, such as graphite. The intermediate electrode 42 extends up to the free ends of the contact fingers 30 and in the cut-on position engages by means of its peripheral region with the inner diameter of the burn-off tip or element 24. The continuous bore 43 provided in the intermediate electrode 42 opens at its end, which is mounted in the sleeve 41, into a chamber or compartment 44 formed in the holder or support block 26. Protruding radially from the chamber 44 are the bores 45 which, in turn, open into the part of the extinguishing chamber or compartment 13 which is surrounded by the holder block 26. Hence, there is formed a free flow connection which, during the cut-off operation, renders it possible for the pressurized gases which are formed under the action of the arc to flow as rapidly as possible into the extinguishing chamber 13 and from that location—as will still be described more fully hereinafter—by means of the bore 21 and the passages 22 to expand within the expansion chamber 14.

The movable contact element 16 is operatively coupled with a pump device or pump means 46 arranged in the extinguishing chamber or compartment 13. This pump device 46 possesses a piston 47 seated upon the contact element 16, this piston 47 being displaceable within a cylinder 49 coaxially suspended, with respect to the contact element 16, at radial struts 48 or equivalent supporting means. The lower, i.e. the side of the cylinder 49 facing away from the contact set 25, is open, whereas its oppositely situated side is closed by a flange or partition wall 50 through which piercingly extends the contact element 16. Since the outer diameter of the cylinder 49 is less than the inner diameter of the housing 11, a jacket shaped flow channel 51 remains free about the cylinder 49. At the side of the piston 47, facing away from the open side or face of the cylinder 49, there are provided within the contact element 16 transverse bores 52 which originate from the blindhole bore 21.

During the cut-off stroke there occur approximately the following operations. Initially, the end of the movable contact element 16 comes out of engagement with the contact surfaces 34. The arms or arm members 33 of the contact fingers 30 move resiliently inwardly to such an extent until the burn-off elements or pieces 36' contact the burn-off tip 24, and thus, there is established a good electrical contact with the burn-off tip 24. The cut-off current now flows only through the burn-off elements or pieces 36' of the burn-off ring 36 and the burn-off tip 24. If such departs from the burn-off ring 36 then initially there is drawn an arc between both of these elements. With increasing axial spacing of the burn-off tip 24 with respect to the burn-off ring 36 the arc commutates to the intermediate electrode 42, so that the cut-off current now flows—it is to be noted that the burn-off tip 24 has not yet departed from the intermediate electrode 42—by means of the burn-off ring 36, the arc, the intermediate electrode 42 and via the burn-off tip 24. At the same time there is developed within the extinguishing chamber 13 an increased gas pressure due to the arc. Now if the burn-off tip 24 also departs from the intermediate electrode 42, then between both of these elements there is drawn a further arc, and at the same time there prevails a direct flow communication to the expansion chamber 14, namely, as already mentioned, by means of the inside of the burn-off tip 24, the bore 21 and the passages 22, which in the meantime have moved out of the region of the holder ring 18. Consequently, the pressure which has built-up in the extinguishing chamber 13 can be relieved in the direction of the expansion chamber 14, so that the switching arc which burns between the intermediate electrode 42 and the burn-off tip 24 can be powerfully blown by the gas flow and propelled into the burn-off tip 24. The arc which burns between the burn-off ring 36 and the intermediate electrode 42 does not have any cause to commutate to the contact fingers 30; firstly owing to the fact that the radial spacing to the contact fingers 30 is greater than to the inner diameter of the burn-off ring 36, and secondly, because the gas developed by the insert members or inserts 39 and 40 constitutes a hindrance for any commutation.

The contact surfaces, over which flows the rated current, namely the contact surfaces 34 and the outer diameter or surface of the movable contact element 16 therefore remain free of any burn-off, which, in turn, only arises at the burn-off elements or pieces 36', at the intermediate electrode 42 and at the burn-off tip 24, in other words, at easily exchangeable parts which are subject to wear.

In particular, during the cut-off of comparatively low currents, i.e. in the presence of weak switching arcs, which only cause a relatively low pressure increase within the extinguishing chamber 13, the pump device 46 forces a flow of the extinguishing gas upwardly through the flow channel 51 to the separation path and from that location through the contact element 16 downwardly into the expansion chamber 14.

By way of completeness it is here further mentioned that the volume of the pump cylinder 49 is advantageously chosen to be greater than that of the expansion chamber 14, for instance, is twice as large, although in this respect it is remarked that the drawings which are not to scale do not show this relationship of the respective volumes.

While there are shown and described present preferred embodiments of the invention, it is to be distinctly understood that the invention is not limited thereto but may be otherwise variously embodied and practised within the scope of the following claims. Accordingly,

What I claim is:

1. A gas-blast switch comprising:

a switch housing containing an internal space;

a first partition wall for dividing the internal space of the switch housing into an extinguishing chamber and an expansion chamber;

a movable substantially tubular-shaped contact element displaceably guided through said partition wall;

said contact element, during a cut-off stroke of the gas-blast switch, establishing a flow communication between both of said chambers;

a fixed contact set arranged in said extinguishing chamber;

said fixed contact set coacting with said movable contact element;

said fixed contact set having a rim of rated current contacts which, in a cut-on position of the gas-blast switch, engages about the movable contact element;

a burn-off ring electrically connected with the rim of rated current contacts;

an intermediate electrode which is electrically insulated from the rated current contacts;

said intermediate electrode, in the cut-on position of the gas-blast switch sealingly engaging with the movable contact element;

said movable contact element during the course of a cut-off stroke initially coming out of engagement with the rated current contacts and only thereafter coming out of engagement with the intermediate electrode, so that initially an arc is drawn between the burn-off ring and the intermediate electrode;

said movable contact element and said fixed contact set defining therebetween a separation path during said cut-off stroke;

a second partition wall for dividing said extinguishing chamber into a zone including said separation path and a zone remote from said separation path;

said burn-off ring being arranged within the rim of rated current contacts and being rearwardly inset with respect to contact surfaces of the rated current contacts which coact with the movable contact element;

a pump device operatively connected with the movable contact element and disposed in said zone remote from said separation path; and said pump device conveying, during the cut-off stroke of the gas-blast switch, an extinguishing gas out of said zone remote from said separation path through said second partition wall into the zone including said separation path.

2. The gas-blast switch as defined in claim 1, wherein:

said pump device comprises a piston attached to the movable contact element;

a cylinder;

means for suspending said cylinder in the zone remote from said separation path;

said piston being displaceable within said cylinder;

said cylinder having a side facing away from said second partition wall which is open.

3. The gas-blast switch as defined in claim 2, wherein:

said cylinder is arranged substantially coaxially with respect to the movable contact element;

said second partition wall comprising flange means for closing a side of the cylinder which confronts the fixed contact set; and said movable contact element piercingly extending through said flange means.

4. The gas-blast switch as defined in claim 3, wherein:

said movable contact element possesses at least one transverse bore means at a region thereof located between said flange means of the cylinder and the piston.

5. The gas-blast switch as defined in claim 1, wherein:

an end of the movable contact element is formed by a substantially tubular-shaped burn-off tip;

said burn-off tip being closed in the cut-on position of the gas-blast switch by the intermediate electrode and having a small radial play with respect to the burn-off ring; and the outer diameter of the burn-off tip being smaller than the outer diameter of the remaining portion of the movable contact element.

6. The gas-blast switch as defined in claim 5, further including:

insert means arranged between the burn-off ring and contact surfaces of the rated current contacts; and said insert means being formed of a material which gives off a gas in the presence of the action of a switching arc.

7. The gas-blast switch as defined in claim 6, wherein:

said insert means and said burn-off ring are supported by the rated current contacts.

* * * * *

UNITED STATES PATENT AND TRADEMARK OFFICE

CERTIFICATE OF CORRECTION

PATENT NO. : 4,375,023

DATED : February 22, 1983

INVENTOR(S) : Hans-Rudolf Wuthrich et al.

It is certified that error appears in the above-identified patent and that said Letters Patent is hereby corrected as shown below:

The title page should appear as shown on the attached sheet.

Signed and Sealed this

*Tenth* Day of *May 1983*

[SEAL]

*Attest:*

GERALD J. MOSSINGHOFF

*Attesting Officer*

*Commissioner of Patents and Trademarks*

United States Patent [19]

Wüthrich et al.

[11] 4,375,023

[45] Feb. 22, 1983

[54] GAS-BLAST SWITCH

[75] Inventors: Hans-Rudolf Wüthrich; Hubert Speigel, both of Oberentfelden; Hermann Lehner, Gränichen; Peter Krebs, Hirschthal, all of Switzerland

[73] Assignee: Sprecher & Schuh AG, Aarau, Switzerland

[21] Appl. No.: 138,116

[22] Filed: Apr. 7, 1980

[30] Foreign Application Priority Data

Jul. 10, 1979 [CH] Switzerland ..... 6416/79

[51] Int. Cl.[3] ..... H01H 33/70; H01H 33/12

[52] U.S. Cl. ..... 200/148 R; 200/146 R; 200/148 A

[58] Field of Search ..... 200/146 R, 148 R, 148 A

[56] References Cited

U.S. PATENT DOCUMENTS 4,296,289 10/1981 Wuthrich et al. ..... 200/146 R

*Primary Examiner*—Robert S. Macon

*Attorney, Agent, or Firm*—Werner W. Kleeman

[57] ABSTRACT

A movable, tubular-shaped contact element is displaceably guided in a partition wall subdividing the internal space of the gas-blast switch housing into an extinguishing chamber and an expansion chamber. During the cut-off stroke a current connection prevails by means of this contact element between both of the chambers or compartments. The contact element coacts with a stationary or fixed contact set having a rim of rated current contacts which, in the cut-on position, engage about the contact element. Further, there is provided a burn-off ring which is electrically connected with the contact element and has an electrically insulated, suspended intermediate electrode which, in the cut-on position, engages into the contact element or piece. The latter, during the cut-off stroke, initially comes out of engagement with the rated current contacts and first thereafter comes out of engagement with the intermediate electrode. In order to ensure that the part of the switching arc which burns between the burn-off ring and the intermediate electrode remains at this location and that its other part, even in the presence of low currents, is sufficiently blown, the burn-off ring is arranged within the rim of rated current contacts and is rearwardly inset with respect to the contact surfaces thereof, and furthermore, a pump device is coupled with the movable contact element. This pump device, during the cut-off stroke, conveys extinguishing gas out of the region of the extinguishing chamber which is remote from the separation path to the separation path.

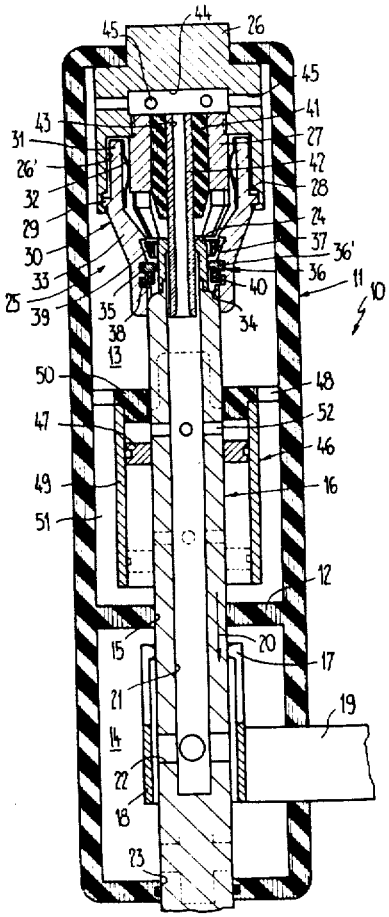

7 Claims, 1 Drawing Figure